US010362868B2

(12) United States Patent
Haug

(10) Patent No.: US 10,362,868 B2
(45) Date of Patent: Jul. 30, 2019

(54) COMPACT BROOM AND DUST MOP STORAGE RACK

(71) Applicant: Edward W Haug, Columbus, OH (US)

(72) Inventor: Edward W Haug, Columbus, OH (US)

( * ) Notice: Subject to any disclaimer, the term of this patent is extended or adjusted under 35 U.S.C. 154(b) by 72 days.

(21) Appl. No.: 15/420,049

(22) Filed: Jan. 30, 2017

(65) Prior Publication Data

US 2018/0213933 A1 Aug. 2, 2018

(51) Int. Cl.
*A47B 81/00* (2006.01)
*A47B 81/02* (2006.01)

(52) U.S. Cl.
CPC ..... *A47B 81/005* (2013.01); *A47B 81/02* (2013.01)

(58) Field of Classification Search
CPC ..... A47B 81/02; A47B 81/05; A01K 97/10
USPC ..... 211/64, 68, 70.8, 70.6, 65, 85.6, 85.7; D6/682.4
See application file for complete search history.

(56) References Cited

U.S. PATENT DOCUMENTS 189,606 A * 4/1877 Clark, Jr. ..... A47K 1/09 211/65
331,011 A * 11/1885 Thompson ..... B25H 3/04 211/70.6
402,013 A * 4/1889 Gable ..... A47F 7/024 211/4
450,858 A * 4/1891 Zan ..... A47K 1/09 211/65
731,642 A * 6/1903 Wilder ..... A47K 1/09 211/65
838,473 A * 12/1906 Speiser ..... A47K 1/09 211/204
D44,078 S * 5/1913 Treadway ..... 211/65
1,538,849 A * 5/1925 Eger ..... A47F 5/10 211/189
2,058,184 A * 10/1936 Sherrard ..... G10G 5/00 211/20
D157,241 S * 2/1950 Del Pozo ..... 211/64
D162,207 S * 2/1951 Mettenleiter ..... 211/64
2,587,226 A * 2/1952 Rodman ..... B25H 3/04 211/65
3,004,673 A * 10/1961 Emery ..... A47F 7/0028 211/70.8
4,461,385 A * 7/1984 Clouser ..... A47B 81/005 211/4
D312,016 S * 11/1990 Montgomery ..... D6/552
D343,309 S * 1/1994 vonBatsch ..... D6/682.6
5,657,883 A * 8/1997 Badia ..... A01K 97/10 211/60.1
6,547,085 B2 * 4/2003 Belisle ..... A47B 81/005 211/85.7
6,783,013 B1 * 8/2004 Spann ..... B25H 3/04 211/60.1
7,040,636 B2 * 5/2006 Stoffels ..... B62B 1/262 280/47.19
D650,611 S * 12/2011 Melhart ..... D6/682.4
8,479,928 B2 * 7/2013 Tanabe ..... A47B 43/00 211/64
D702,065 S * 4/2014 Moore ..... D6/682.4
(Continued)

*Primary Examiner* — Stanton L Krycinski

(57) ABSTRACT

A free standing, or wall mounted narrow storage rack composed of two side panels, and three horizontal panels created primarily for storage of brooms, dust mops and similar shaped items by the handle or shaft vertically in narrow spaces preventing contact with the wall and allowing easy access or retrieval thru the top, side or front.

7 Claims, 2 Drawing Sheets

(56) References Cited

U.S. PATENT DOCUMENTS

| | | | | |
|---|---|---|---|---|
| D776,956 | S * | 1/2017 | Ma | D6/552 |
| 2010/0122960 | A1 * | 5/2010 | Bliss | A47B 43/00 211/64 |

* cited by examiner

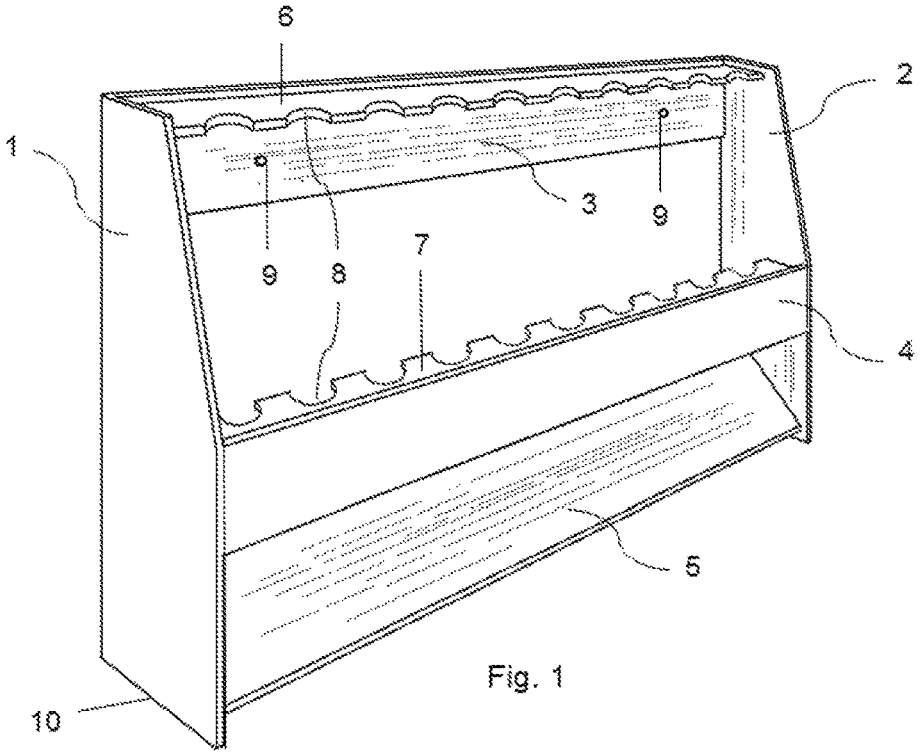
Fig. 1
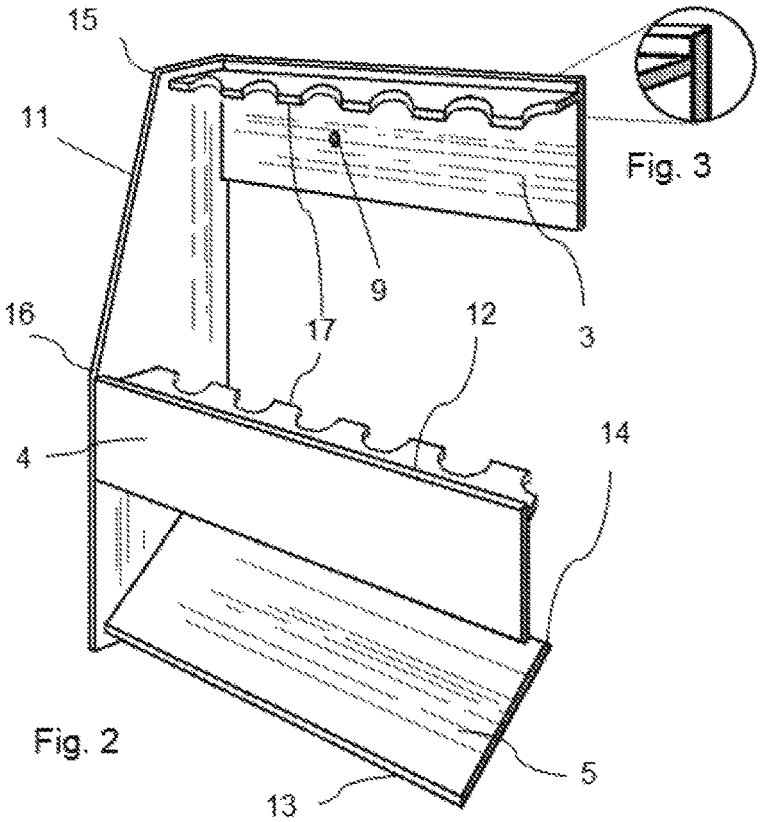
Fig. 3
Fig. 2

COMPACT BROOM AND DUST MOP STORAGE RACK

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

This present invention relates to a rack for storing household items, particularly brooms, dust mops, canes or any other similarly shaped items in compact narrow spaces for easy access in the home.

Most people store brooms, dust mops, canes and similar shaped implements in a corner or a closet where they fall, become misplaced, or in the case of brooms result in misshaped bristles. This has created a need for storage devices and related art to retain these items when not in use. In the related art, many mechanisms are available for holding brooms, mops and similar shaped implements. These devices can be of plastic, wood or metal or a combination thereof, and either simple or complex configurations. Often times the devices are difficult to use and may require two hands to retrieve and store the item thus presenting a problem for persons with manual dexterity impairments.

The inventor, after experiencing many of the shortcomings identified above, developed an invention over a period of several months that addresses the deficiencies listed and provides superior storage. During the development time multiple prototypes were constructed of various materials. Prototypes were placed in different locations to determine the preferred design, size, embodiment and access method. Changes were made to component spacing, thickness, and size to develop the invention described in this application.

Various devices have been created in prior art for holding brooms and dust mops. Many use a binding action, hooks, loops, slots or hangers to hold the item elevated against a wall, either by the head pointing up and the handle down, or vice versa. The related art does not adequately address problems associated with the stored items becoming stuck, stored items falling from their elevated positon after being bumped, difficulty in storing and retrieving the items, space required, and wall soiling and scuffing due to the repetitive nature of retrieving and storing the implements against the wall.

U.S. Pat. No. 838,473 discloses a broom rack that stores multiple brooms, however it is not properly suited for use within the home due to the space required and number of brooms that can be stored exceeds the number required by most households.

US Pat No 20040188367 discloses a rack for storing long handled tools, however the rack requires that items be brought up through the top of the rack, and the shape may not make it suitable for narrow spaces.

US Pat No 20060208138 discloses a tool holder with a binding action. These types of storage devices depend upon the wall for resting the tool which may result in soiling or scuffing the wall and may require two hands to store and release.

U.S. Pat. No. 2,422,891 discloses a loop type holder for single item storage. This type of device would require two hands to retrieve and replace, and would also require storage against the wall which may result in soiling or scuffing.

Therefore a need has been identified for an improved yet simple device that will provide secure storage for multiple brooms, dust mops and similar implements using a minimum amount of space and will provide easy access.

BRIEF SUMMARY OF THE INVENTION

The invention described herein can be placed on the floor, or wall mounted on a low narrow section of wall and provides vertical implement storage. By design it keeps the stored item off of the wall thereby reducing the likelihood of wall soiling and scuffing, and secures the implement with the force of gravity.

The invention is made up of two side panels attached to opposite ends of three parallel panels. The two upper parallel panels each have a rail facing one another. The upper and middle panel rails have a corresponding series of semicircular notches spaced equal distance apart that allow an item to be placed by the shaft vertically into the corresponding notches of the upper and middle panels and to come to rest on the angled lower panel. It utilizes the force of gravity to keep the items at rest.

The invention allows for multiple stored items, eliminates the possibility of items falling from an elevated position, prevents misshaped bristles, and allows for easy storage and retrieval with one hand.

The narrow profile of this storage rack make it ideal for narrow spaces not normally utilized for storing cleaning equipment, for example free standing or mounted on the wall behind a door, on the wall in a closet, on the floor beside a dryer or washing machine, or any narrow space.

The low profile and angled side panel allow for the stored items to be easily retrieved by raising the item vertically over the front panel and out, or up and across the partial side panel if the front is obstructed, for example in the narrow space beside a washing machine. The narrow, angled sidewall design and low profile of the front panel allow items to be retrieved from the side, top or front.

It is an object of the present invention to be manufactured inexpensively from wood, molded plastic, or metal or a combination thereof; and as a single unit or in pieces for inexpensive shipping and easy assembly into the finished product described herein.

BRIEF DESCRIPTION OF THE DRAWINGS

Illustrations are provided below to give an understanding of the invention. The accompanying drawings, and figures are not necessarily to scale.

FIG. 1 is a perspective view of the invention showing the present invention in greater detail FIG. 2 is a cross section of the perspective view of the invention showing additional detail FIG. 3 is an exploded view of the perpendicular rail affixed to the back panel.

DETAILED DESCRIPTION OF THE INVENTION

Figure 4:
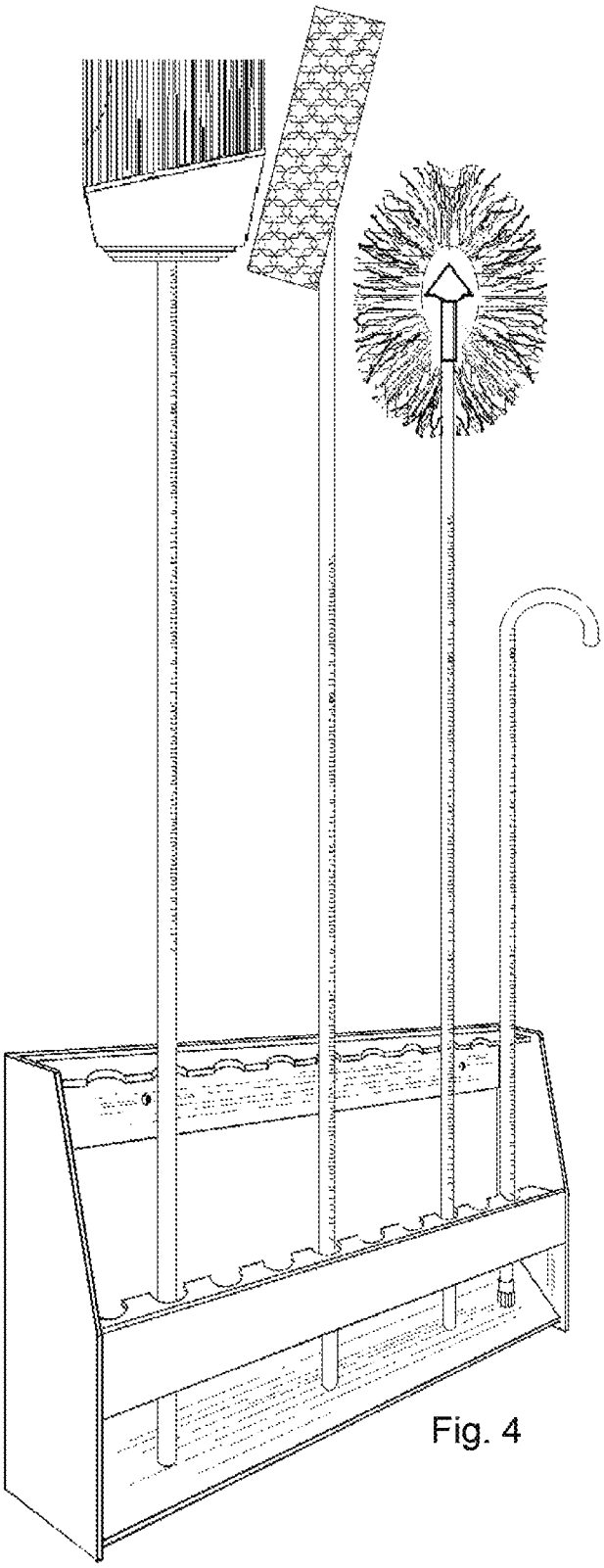
FIG. 4 is a perspective view of the invention with stored items to provide an example the preferred embodiment of the functioning invention.

The features of this invention are disclosed in detail in order to clearly identify the invention however it is to be understood that the invention as disclosed is not limited to the exact form since minor modifications and changes may be made without departing from the design and function of the invention.

FIG. 1 is a perspective view of device showing the three horizontal panels 3, 4 and 5. The upper two panels, 3 and 4, are similarly designed where each panel has a perpendicular rail 6 and 7 along the length of the panel. Each rail has multiple semi-circular recesses 8, for resting the stored items. The side panels 1 and 2 are attached to the horizontal panels, and hold the horizontal panels 3, 4 and 5 together and maintain the space between the horizontal panels.

The upper panels 3 and 4 have perpendicular rails 6 and 7 attached to the face containing relatively spaced semicircular cutouts facing each other to allow the stored item to be placed vertically with the shaft first over the front panel 4 within the corresponding semi-circular recesses of the upper two panels 8, and come to rest on the slanted base panel 5. The upper panel 3 has mounting holes 9 that allow the panel to be attached to a wall. The rack has a flat base 10 that allows it to be placed on the floor to be free standing.

FIG. 2 is a cross section of the three horizontal panels of the invention as describe above. The base panel is slanted downward from the back 14 towards the front 13 of the invention. The side panels are tapered 11 from the top center 15 of the side panel to the front center 16 of the side panel to allow access across the side panel if it is mounted with a front obstruction. The slanted base 5 forces the stored item to be pushed toward the recess of the middle panel 1*b*, which in turn forces the stored item to rest securely in the corresponding recess of the back panel 1*a* using the force of gravity. The fixed distance of front edge between recesses of the upper and lower rails 17 maintain separation between the stored items.

FIG. 3 is an exploded view of the back of a semicircular cutout on perpendicular rail to illustrate the clearance available that prevents stored item resting on a wall when wall mounted.

FIG. 4 represents a perspective view of one embodiment of the functioning invention.

The benefits of this invention are that it allows for multiple items to be stored, allows easy replace and retrieval with one hand, stores items vertically preventing contact with walls, stores securely, allows access from the front, side and top, and can be utilized in narrow spaces not normally utilized in the home.

It is an object of the present invention to be manufactured inexpensively from wood, molded plastic, or metal or a combination thereof; and as a single unit or in pieces for inexpensive shipping and easy assembly into the finished product described herein.

The invention claimed is:

1. A compact dust mop and broom storage rack comprising:

two symmetrical parallel vertical end panels, facing one another enclosing three horizontal panels of equal length, the three horizontal panels include an upper horizontal panel having a flat back side, and a perpendicular rail facing a front along the length of the upper horizontal panel, the perpendicular rail of the upper horizontal panel having a plurality of semi-circular notches spaced equal distance apart along the perpendicular rail, and bounded by one of the symmetrical vertical end panels at one end of the upper horizontal panel length, and the other symmetrical vertical end panel at the opposite end of the upper horizontal panel length;

a middle horizontal panel having a flat front side, and a perpendicular rail facing a back along the length of the middle horizontal panel, the perpendicular rail of the middle horizontal panel having a plurality of semi-circular notches spaced equal distance apart along the perpendicular rail, where each semi-circular notch on the perpendicular rail of the middle horizontal panel has an open end facing an opposite direction of a corresponding semi-circular notch on the perpendicular rail of the upper horizontal panel, and the middle horizontal panel is bounded by one of the symmetrical vertical end panels at one end of the middle horizontal panel length, and the other symmetrical vertical end panel at the opposite end of the middle horizontal panel length;

a lower horizontal panel that is sloped downwards toward the front of the compact dust mop and broom storage rack, and bounded by one of the symmetrical vertical end panels at one end of the lower panel length, and the other symmetrical vertical end panel at the opposite end of the lower horizontal panel length.

2. A compact dust mop and broom storage rack according to claim 1 where the upper horizontal panel has holes to allow for mounting on a wall or flat surface.

3. A compact dust mop and broom storage rack according to claim 1 where the storage rack has a narrow profile allowing the storage rack to be installed or placed in a space requiring four inches clearance from front to back.

4. A compact dust mop and broom storage rack according to claim 1 where the corresponding semi-circular notches of the perpendicular rails of the upper and middle horizontal panels allow for vertical storage.

5. A compact dust mop and broom storage rack according to claim 1 where each of the vertical end panels have a flat base to allow free standing on a flat surface.

6. A compact dust mop and broom storage rack according to claim 1 where the distance between a back of each semicircular notch along the perpendicular rail of the upper horizontal panel, and the flat back side of the upper horizontal panel provides enough clearance to prevent stored items from touching adjacent surfaces when the rack is mounted.

7. A compact dust mop and broom storage rack according to claim 1 where each vertical end panel is partially open to allow retrieval from a side when the front is obstructed.

* * * * *